United States Patent [19]

Gaiser

[11] 4,326,322

[45] Apr. 27, 1982

[54] BEAMING MACHINE

[75] Inventor: Gerhard O. Gaiser, Norwalk, Conn.

[73] Assignee: American Fabrics Company, Bridgeport, Conn.

[21] Appl. No.: 20,933

[22] Filed: Mar. 15, 1979

[51] Int. Cl.[3] ..... D02H 5/00; D02H 13/08; D02H 13/26

[52] U.S. Cl. ..... 28/187; 28/194; 28/195

[58] Field of Search ..... 28/187, 190, 192, 194, 28/195, 199, 200

[56] References Cited

U.S. PATENT DOCUMENTS

| | | | |
|---|---|---|---|
| 2,033,738 | 3/1936 | Reiners et al. | 28/195 |
| 2,098,418 | 11/1937 | Francis | 28/194 |
| 2,438,365 | 3/1948 | Hepp et al. | 28/187 X |
| 2,797,468 | 7/1957 | Brown | 28/194 |
| 3,094,855 | 6/1963 | Vossen | 28/194 X |
| 3,991,448 | 11/1976 | Kracke et al. | 28/195 |
| 4,177,838 | 12/1979 | Van Wilson et al. . | |

FOREIGN PATENT DOCUMENTS

| | | | |
|---|---|---|---|
| 906080 | 7/1972 | Canada | 28/187 |
| 113913 | 9/1900 | Fed. Rep. of Germany | 28/195 |
| 2519231 | 11/1976 | Fed. Rep. of Germany | 28/187 |
| 249465 | 7/1926 | Italy | 28/192 |
| 17296 | of 1892 | United Kingdom | 28/194 |

*Primary Examiner*—Robert Mackey

*Attorney, Agent, or Firm*—Mattern, Ware, Stoltz & Fressola

[57] ABSTRACT

A beaming machine (beamer) suitable to run any common width beam for Raschel-type knitting machines, having three beams or heads with individual traverse settings so that different yarn end counts can be simultaneously wound on each beam. Uniform yarn tension is obtained at each beam by a series of two rollers positioned between the beam and the yarn creel over which each yarn end must pass. An evenly wound beam is thereby obtained for each of the three beams. Doffing time is minimized by the tensioning rollers in conjunction with pigtail-shaped yarn end guides mounted on one of a plurality of reeds adapted for the various end counts capable of being wound by the machine. Yarn breakage is detected by the breaking of a light beam in conjunction with an air sheet generated from an air slit for each beam. An air sheet is directed toward each yarn sheet so as to blow any broken yarn end across the light beam and thereby electronically initiate a shutdown of the beamer.

12 Claims, 12 Drawing Figures

REED TYPE (COLOR CODED)

| NUMBER OF ENDS | RED | WHITE | GREEN | YELLOW | BLUE | BLACK | ORANGE | YARN END GUIDES-USED |
|---|---|---|---|---|---|---|---|---|
| 0 TO 19 | X | | | | | | | IN-3 OUT |
| 20 TO 22 | | X | | | | | | IN-3 OUT |
| 23 TO 25 | | | X | | | | | IN-3 OUT |
| 26 TO 27 | | | | X | | | | IN-3 OUT |
| 28 TO 29 | | | | | X | | | IN-3 OUT |
| 30 TO 32 | | | | | | X | | IN-3 OUT |
| 33 TO 35 | | | | | | | X | IN-3 OUT |
| 36 TO 40 | X | | | | | | | IN-3 OUT |
| 41 TO 45 | | X | | | | | | IN-3 OUT |
| 46 TO 50 | | | X | | | | | IN-3 OUT |
| 51 TO 65 | | | | X | | | | IN-3 OUT |
| 56 TO 60 | | | | | X | | | IN-3 OUT |
| 61 TO 65 | | | | | | X | | IN-3 OUT |
| 66 TO 70 | | | | | | | X | IN-3 OUT |
| 71 TO 80 | X | | | | | | | FULL ALL IN |
| 81 TO 90 | | X | | | | | | FULL ALL IN |
| 91 TO 100 | | | X | | | | | FULL ALL IN |
| 101 TO 110 | | | | X | | | | FULL ALL IN |
| 111 TO 120 | | | | X | | | | FULL ALL IN |
| 121 TO 130 | | | | | X | | | FULL ALL IN |
| 131 TO 140 | | | | | | X | | FULL ALL IN |

BEAMING MACHINE

BACKGROUND ART

This invention is directed to beaming machines, and particularly such machines used for winding beams used in Raschel knitting machines. Although beaming machines (sometimes called beamers) are well known in the art, such machines have typically either wound only one beam at a time or two beams with the identical traverse movement and therefore identical or nearly identical end count. It has not been possible in prior art machines including those made by the Mayer Company (West Germany) to simultaneously wind more than one beam with different traverse movements on the same beaming machine.

It has also been impossible on prior art beamers to overcome the tension variations between the yarn creel and beam for different yarn ends so that each end is wound on the beam at nearly the same tension. The present invention through use of a pair of rollers over which the incoming yarn ends travel is able to provide a virtually identical yarn tension for each end wound on each beam. The yarn tensions for different beams may be varied from one another.

It has also been a common problem in beaming machines to detect yarn breakage. Typically each yarn end was passed through a hole in a pivotal mechanical switch member so as to detect the presence of the yarn end. If a yarn end broke, the switch member would swing down and make contact with a mating member to close the switch and initiate shutdown of the beamer. These devices have traditionally been beset with problems including the amount of set-up or doffing time required to initiate the winding of a beam as well as occasional failure to stop the machine when a yarn break occurred. This latter condition is especially prevalent when texturized yarns are wound since such yarns contain a small amount of oil which is slowly deposited on the switch member. This accumulated oil can occasionally insulate the switch member and prevent it from making electrical contact.

The present invention overcomes these difficulties by eliminating the use of such yarn end mechanical switch members. It performs yarn breakage sensing by means of air sheets individually projected upwardly along the incoming yarn sheet for each beam so that a break in any yarn end breaks a light beam which is then detected by a photoelectric device causing an orderly shutdown of the beamer. Although photoelectric devices have been utilized in knitting machines, they have not been previously utilized in beamers. Furthermore, the present invention carries the pressurized air used in forming the air sheet by means of conduits formed within the beamer frame. This technique saves space in the machine and consequently makes operator handling easier.

DISCLOSURE OF THE INVENTION

The present invention is directed to a beaming machine for winding from 15 to 140 yarn ends onto three beams with the width of the wound portion of the beam ranging from 75 inches (190.5 cm) to 130 inches (330.2 cm) or wider. Such beams are typically used in Raschel type knitting machines manufactured in various countries including West Germany and Japan and by such companies as Kidde, Mayer, and Liba. Raschel knitting machines are a type of loom for performing warp knitting resembling tricot and usually with openwork patterns. Such machines are, of course, well known in the art. The beams commonly comprise texturized and non-texturized yarns fabricated from all types of polyester and nylon filaments. Natural fibers such as cotton, wool, and all acrylic fibers, both thrown and unthrown, can also be wound on such beams.

The present invention is a beaming machine which is able to simultaneously wind three individual beams with the traverse movement of the yarn ends ranging from as little as 0.625 inch (15.9 mm) to as much as eight inches (203.2. mm) corresponding to as many as 140 yarn ends to as few as 15 yarn ends. The multiple traverse assembly comprises individual traverse mechanisms used to reciprocatively move reeds containing yarn end guides. Each traverse mechanism is independently adjustable. They are all moved by a cam assembly driven through an infinitely variable transmission from the motor turning the beams. Therefore, the desired traverse movement and the rate of this movement with respect to the winding speed of the beam is obtained. Thus, the width of the beam segment for each yarn end is adjustable as well as the number of beam rotations per sweep of the beam segment by the yarn end.

The individual traverse movement for each of the three beams greatly reduces the otherwise time consuming setup or doffing time associated with prior art beamers since it is no longer necessary to run simultaneous end count beams on a beamer.

The present invention further incorporates a yarn tension equalizing mechanism that eliminates the variations in yarn end tensions as the yarns are drawn from their creels containing standard tensioning devices. As is well known in the art, the yarn ends as they are moved from the creel will have a corresponding higher or lower tension depending upon the amount of yarn left on the associated spool or bobbin. It is also well known that standard yarn tensioning devices associated with such creels are unable to equalize these yarn tension changes. The present yarn tension equalizing mechanism comprises a pair of rollers over which the incoming yarn ends pass with the rollers mechanically engaged with each other and slightly braked so as to equalize and remove the variation in the yarn end tensions as they move toward the winding beam. The rollers are preferably coated with a rubber-type material so that the proper frictional relationship is maintained between the rollers and the yarns. By eliminating these tension variations in the yarn ends, a nearly uniform beam is wound unlike those obtainable in prior art beaming machines.

The yarn end guides through which the yarn ends pass guide the ends onto the rotating beam. These guides are constructed in a pigtail fashion to shorten machine doffing time and to minimize abrading the yarn ends. Prior art beaming machines have typically required the operator to pass the yarn ends through apertures in a comb-like device. This method is not only more time consuming than the pigtail guides but also can cause considerable abrading and snagging of the yarn ends. Such devices are also less accurate with respect to obtaining uniform spacing between the yarn ends. The present invention mounts the yarn guides in one of a plurality of reeds. An operator's chart indicates which bar and which guides on the bar should be used for a particular yarn end count. Typically, the selected reed has each pigtail guide, every other pigtail, or every fourth pigtail used to obtain a desired end count. By this technique, the beaming setup operation is simplified while the end product obtained is more uniform than that normally obtained in prior art beamers.

Furthermore, the present invention incorporates an air tube associated with each beam having an elongated slot formed therein for passing an air sheet therefrom. Each generated air sheet flows out upwardly against the incoming yarn ends (which collectively form a yarn sheet) as they move from the lowermost tension roller to the reed. The air sheet causes any broken yarn end to be blown upward across a light beam. This break in the beam is sensed by a photoelectric device that in turn causes the beaming machine to come to a safe, controlled stop. The air flow to the air tubes is obtained through channeled conduit members forming part of the framework. The air is forced into these hollow frame members by one or more blowers. This technique avoids the use of air hoses for bringing the blower air to the air slot. By so doing, the number of parts in the vicinity of the beams is kept to a minimum, again facilitating operator handling.

The electrical components associated with the photoelectric sensing device, as well as the driving motor, are mounted in enclosures to avoid accidental damage and clutter.

It is therefore a principal object of the present invention to provide a beaming machine capable of independently winding three beams, each having individual traverse settings and corresponding yarn end counts through utilization of three independently manually adjustable traverse assemblies respectively associated with the reed used with one of the beams.

Another object of the present invention is to provide a beaming machine of the above description, in which the traverse assemblies are driven by an infinitely variable gear box associated with the motor driving the beams and thereby obtaining any desired traverse speed for each of the beams.

A further object of the present invention is to provide a beaming machine of the above description incorporating a yarn tension equalizing mechanism for maintaining nearly identical tension for each yarn end as it leaves the tensioning device to be wound about the beam.

A further object of the present invention is to provide a beaming machine of the above description having yarn end guides in the shape of pigtails so as to minimize setup time for the beaming machine; and wherein these pigtails can be mounted in one of a plurality of reeds so that their spacing and number in a reed is directly associated with particular end counts so that for any desired end count, an accompanying chart indicates which bar and which pigtails on the bar to use.

A further object of the present invention is to provide a beaming machine of the above description having a yarn breakage detection mechanism using the generation of an air sheet underneath each yarn sheet so as to cause any broken yarn end to break a light beam which is then detected by a photoelectric device for initiating a controlled stop to the beaming machine.

A still further object of the present invention is to provide a beaming machine of the above description in which the air flow to the air tube used in the generation of the air sheet is through conduits formed within the frame so as to minimize the number of components within the beaming machine and therefore facilitate use of the machine by the operator.

Other objects of the present invention will in part be obvious and will in part appear hereinafter.

BRIEF DESCRIPTION OF THE DRAWINGS

For a fuller understanding of the nature and objects of the present invention, reference should be made to the following detailed description taken in conjunction with the accompanying drawings, in which.

BEST MODE FOR CARRYING OUT THE INVENTION

Figures 1, 2:
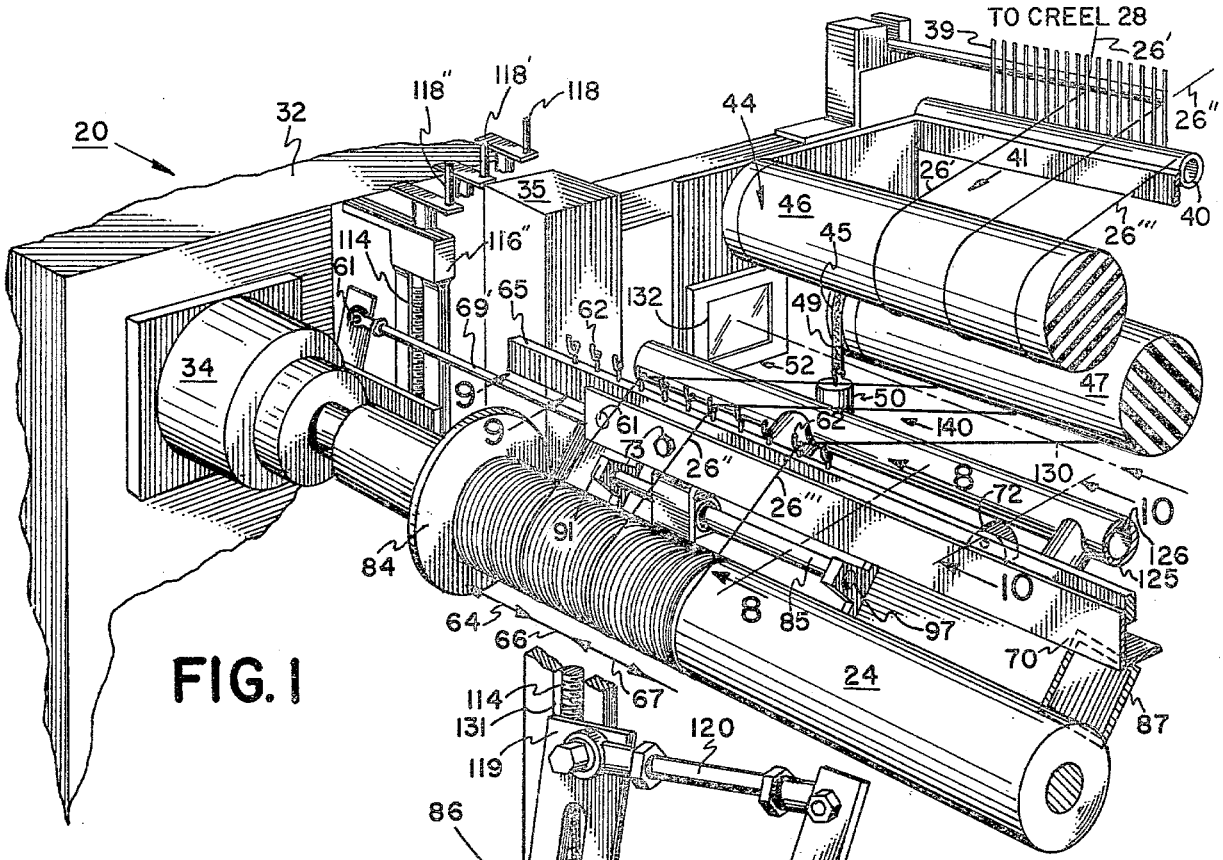
FIG. 1 is a perspective view of a portion of a beaming machine according to the present invention illustrating a portion of the traverse adjusting mechanism, one of the three beams for winding the yarn ends, the pigtail yarn guides mounted within a particular reed for the placement of yarn ends therethrough as they move toward the beam, the reed channel in which the reed is placed, the yarn tension equalizing mechanism comprising a pair of rollers and associated equipment, and the yarn breakage detection equipment including an air tube for generating an air sheet.
FIG. 2 is a rear perspective view partially cut away of one traverse assembly used with the lowermost beam and illustrating the interconnection of all the traverse assemblies to a cam mechanism.

As best seen in 1 and 3, a beaming machine or beamer 20 according to the present invention is able to simultaneously wind three beams 22, 23, and 24 with from 15 to 140 threads or yarn ends 26 depending upon the number of ends desired for the particular beam. As is well known in the beaming machine art, these yarn ends are each individually obtained from creels 28 as diagrammatically shown in FIG. 3. The creel contains individual spools for bobbins 29 (shown digrammatically) upon which the raw yarn thread or end is stored. Associated with each creel is a thread tensioner 31 which is well-known in the industry for attempting to maintain the yarn end tension at a fairly constant value as the bobbin is emptied. In actuality, however, a tension difference of up to 50% can occur between a full and nearly empty bobbin even after adjustment by the creel thread tensioner. In prior art beamers, this has resulted in uneven beams being wound. Such beams yield a lesser quality knitted fabric when used on a Raschel-type knitting machine than if beams with constant yarn tension for all the yarn ends were used. The present invention as described more fully below achieves this desired result.

Figure 3:
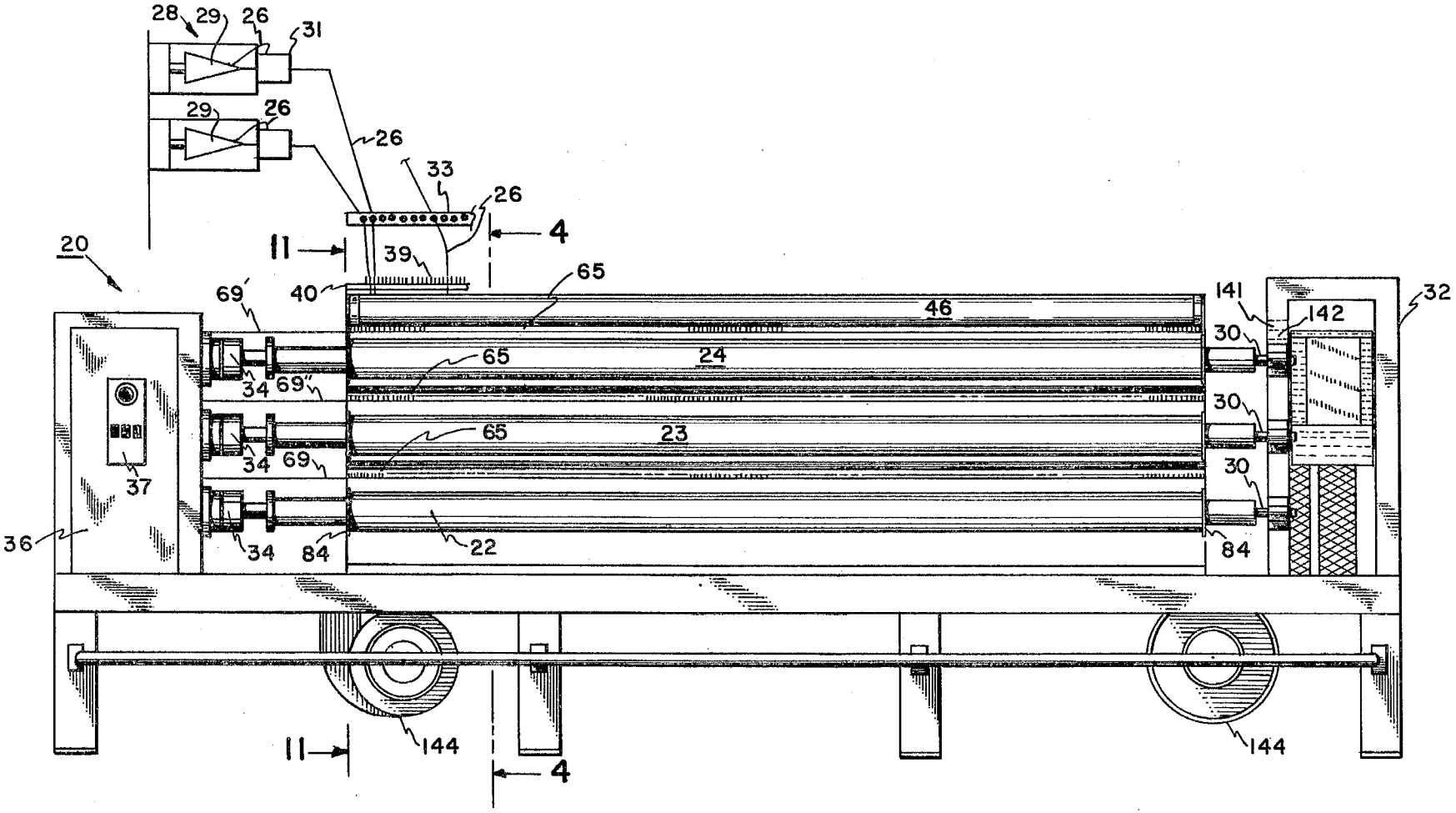
FIG. 3 is a front elevational view of the beaming machine shown in FIGS. 1 and 2, illustrating the three beams which can be simultaneously wound with different end counts having different traverse settings.

As seen in FIGS. 1, 2 and 3, each beam 22, 23 and 24 is mounted at its right end through an axle 30 running through the beam into a mating portion of the beam frame 32. The other end of each axle mates with a driving chuck 34 which is in turn mechanically connected to a motor 21 (shown diagrammatically in phantom) within housing 36. Panel 37 provides the necessary controls for energizing the motor. The motor provides for a beaming machine speed range from 0 to 400 yards per minute (0 to 365.6 meters per minute) which for a standard beam diameter of 7½ inches (19.05 cm) represents an angular velocity speed range of from zero revolutions per minute to approximately 305 revolutions per minute (1,915 radians per minute).

As best seen in FIGS. 1 and 3, each yarn end 26 is set up in the machine to proceed from the corresponding creel 28 to a particular section on the beam 22, 23 or 24. Thus, the yarn ends 26 first pass through an eyelet bar 33 (well-known in the art) and then through fingers 39 in a comb-like member 40. By placing each yarn end through a portion of member 40, the lateral placement of each end can be selected corresponding to the transverse region or segment as shown by arrows 64 and 66 and 67 on the beam on which a particular yarn end is to be wound.

Figures 11, 12:
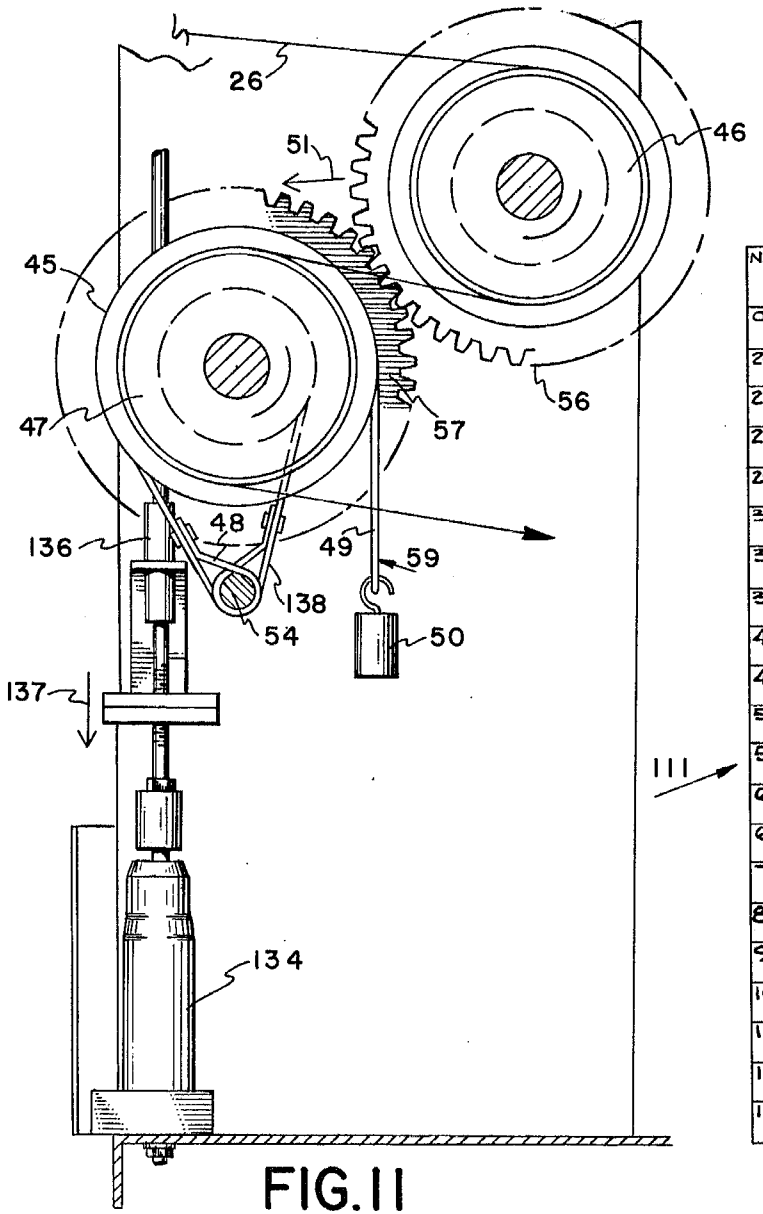
FIG. 11 is a cross-sectional view of the beaming machine taken along line 11—11 of FIG. 3 showing the friction or tension adjusting weight mechanism and the brake mechanism associated with one of the yarn tension equalizing mechanisms.
FIG. 12 is a reed chart showing which color coded reed to use for a desired end count and also which guides to use for the selected reed.

From fingers 39, the yarn end is wrapped around the yarn tension equalizing mechanism 44 which principally comprises upper roller 46, lower roller 47, friction strap 49, weight 50 and gears 56 and 57 (see FIG. 11).

As best seen in FIG. 11, the upper roller 46 corresponding with any of the beams 22, 23 or 24 has a gear 56 mounted to its rightmost end as viewed from FIG. 3, which is intermeshed with gear 57 mounted on lower roller 47. Since gear 56 has 95 teeth while gear 57 has 97 teeth, the upper roller 46 turns at a slightly greater angular velocity than lower roller 47. By so doing, the incoming yarn thread 26 (especially those which are of a higher tension because of the bobbin being nearly empty) is pulled forward by the roller. All of the incoming yarn ends are thereby pulled toward the beaming machine by the upper roller at approximately the same tension so as to compensate for variations in creel yarn tensions. From the upper roller, the yarn ends move to the lower roller as indicated by arrow 51. This roller has a friction generating mechanism 59 comprising strap 49, weight 50, and rod 54. The strap has a loop 48 mounted around the leftmost end of the rod with the weight mounted at the strap's other end so as to wrap about the roller 47 in pulley 45 (see FIG. 1); thereby retarding the roller's otherwise free-wheeling motion. Depending upon the type of yarn being wound on the beam, the weight and therefore the amount of friction applied to the roller can be varied so that a desired difference between the rotation of the rollers (roller surface speed) and the movement of the yarn is obtained. This friction between the yarn ends and the rollers has the effect of causing the yarn ends as they approach the beam to have approximately the same tension. Thus, for light acetate-type yarns having a desired tension of between 8 and 10 grams, a weight of approximately 6 ounces (175 grams) is utilized, whereas for heavy yarns, such as texturized yarns, having a tension of approximately 25 grams, a weight of approximately 12–20 ounces (350–600 grams) is used.

In essence then, the rollers 46 and 47 associated with each beam provide the desired slippage between themselves and the yarn ends so as to pull all the yarn ends from their respective creels, maintain tension on all of the yarn ends, and provide for the exiting yarn ends from the lower roller to have approximately the same tension. It should be noted that the rollers are not powered by any source other than the cumulative force of the yarn ends which form a yarn sheet 140. The force of this yarn sheet is derived from the turning beam 22, 23 or 24 (see FIG. 1). It has been experimentally found that the rollers should have a rubberized coating placed thereon to increase their surface friction with the yarn ends. The rollers have a preferable diameter of 4 inches (10.2 cm). With the coating, the outside diameter of the rollers is approximately 4.125 inches (10.57 cm).

As best seen in FIG. 1, once the yarn ends leave roller 47, they move in a forward direction toward the associated beam 22, 23 or 24 (only beam 24 shown in FIG. 1). In order to be properly guided to the beam segment where the respective yarn is to be wound, it has been the practice in prior art beamers to pass the yarn ends through tiny apertures in a comb-like reed. This prior art technique has many disadvantages including the difficulty in passing the thread through a reed aperture, the abrasion caused to the yarn as it passes through the reed aperture, and the difficulty in determining the spacing between the threads in the reed in order to obtain an approximately uniform beam. In order to obtain a beam without gaps or yarn crossovers, this reed spacing should be approximately equal to the transverse segment 64, 65 and 66 of the yarn end on the beam. For prior art reeds, this required the operator to use some type of measuring device in order to measure the distance between the yarn ends on the reed.

Figure 8:
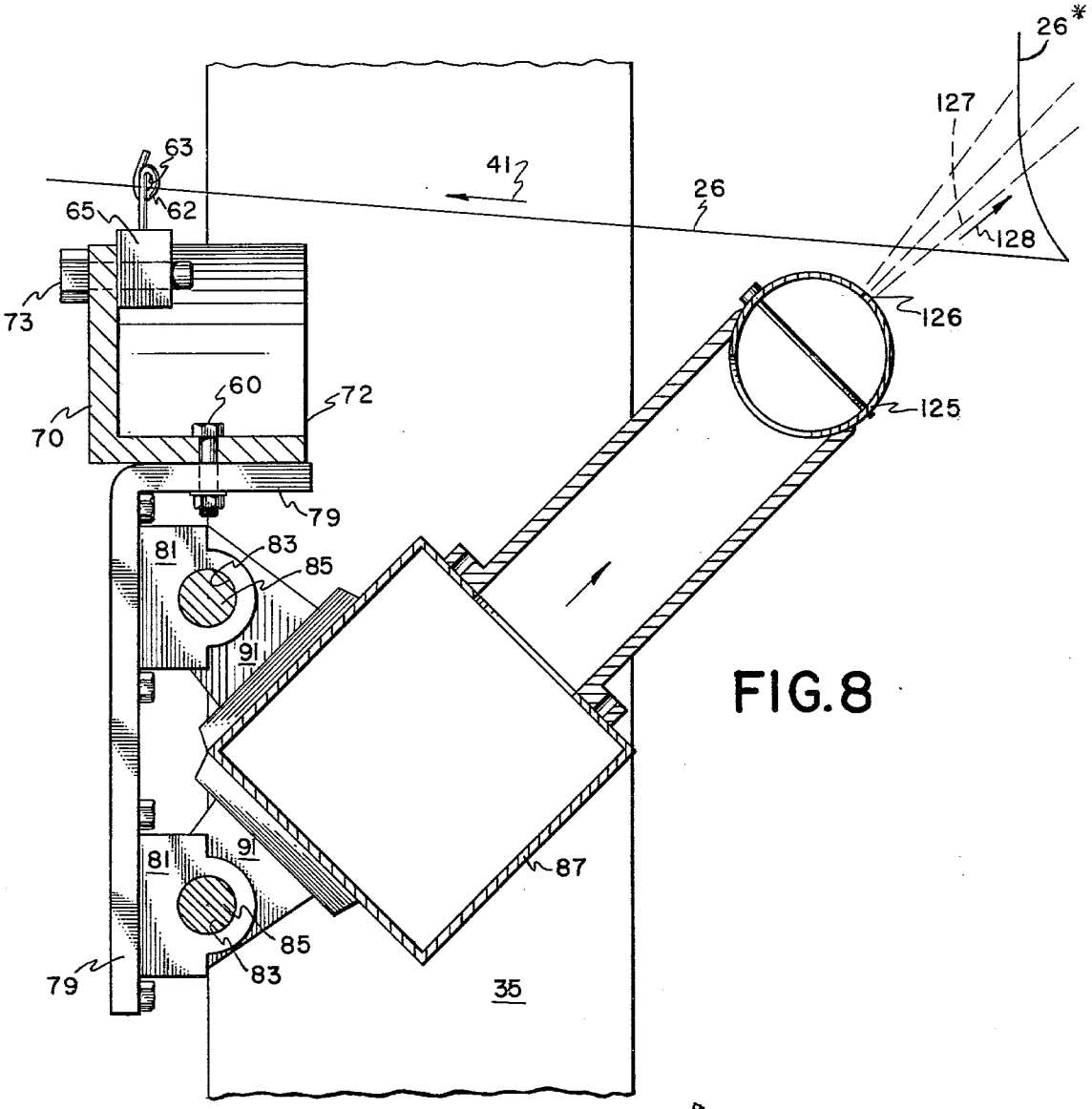
FIG. 8 is an enlarged side sectional view taken along 8—8 of FIG. 1 illustrating the air tube and air conduit associated therewith for generating the air sheet below the yarn sheet passing from the lowermost roller of the uppermost beam.
Figure 9:
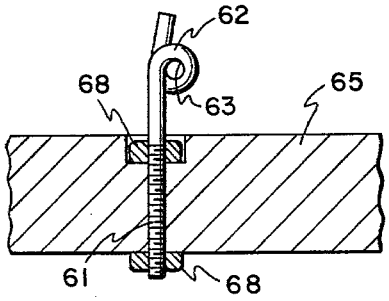
FIG. 9 is a cross-sectional view of a portion of the reed taken along line 9—9 of FIG. 1 showing one yarn end guide pigtail mounted within the reed.

As seen in FIGS. 1, 8 and 9, the present invention overcomes these difficulties in the prior art by use of pigtail-shaped yarn end guides mounted to reeds 65 by nuts 68 mounted onto threaded portion 61 of each pigtail. Each yarn guide pigtail 62 defines an opening 63 through which the yarn end 26 can be placed as shown in FIGS. 1 and 8. The shape of the pigtail allows placement of a yarn end through opening 63 without the need of threading the end therethrough as would be required for an enclosed ring (such as when threading a needle). Each pigtail is fabricated from a high grade stainless steel to minimize friction with the passing yarn end and thereby minimize abrasion and oil residual buildup on the pigtail which can occur for synthetic yarns. The shape of a pigtail also defines a completely smooth opening 63 which cannot snare a yarn end.

As shown in FIG. 1, from the yarn end guide 62, the yarn end passes to the beam 22, 23 or 24 and is wound thereabout by rotation of the corresponding beam as described earlier. In order that the wound beams have a uniform amount of yarn for each yarn end, it is necessary to have the yarn ends move in a transverse back and forth direction with respect to the beam as shown by arrows 64, 66 and 67 for yarn ends 26', 26'' and 26''' respectively. Thus, the finished beam has yarn ends wound thereabout with no gaps between the yarn end segments and desirably with exactly the same tension for each yarn end. The transverse motion or traverse setting of the yarn ends is obtained by moving the reed 65 in a back and forth motion parallel to the beam. This is accomplished by having a control rod 69 move in a back and forth direction equal to the segment width of each yarn end on the beam. Thus, if the yarn ends are spaced between each other by a distance of 3 inches (7.65 cm), it is required that the control rod move in a back and forth direction equal to 3 inches (7.62 cm); that is, the winding of the yarn end on the beam take place in a 3 inch segment as designated by arrows 64, 66 and 67. As shown in FIG. 1, the yarn ends are at approximately their middle location and consequently move to the left and right an equal amount, as shown by arrows 64, 66 and 67. The mechanism for controlling the movement of the control rod is explained later.

Figure 10:
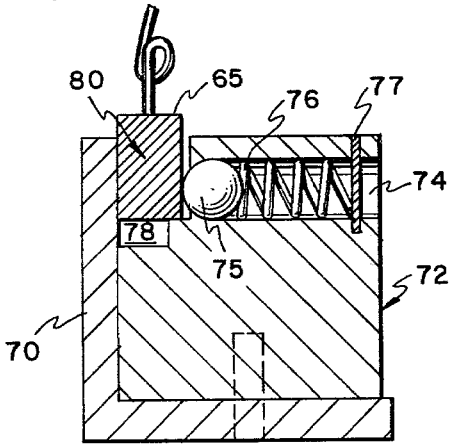
FIG. 10 is an enlarged cross-sectional view taken along line 10—10 of FIG. 1 illustrating the reed channel and spring loaded mounting block for receipt of the reed.

As best seen in FIGS. 1, 8 and 10, the reed is positioned onto a reed channel 70 by means of machine screw 73 and spring loaded blocks 72. The block has an aperture 74 passing horizontally therethrough in which a ball 75 is mounted with a corresponding push-spring 76 and a spring capture plate 77. The ball is thereby pushed against the forward opening 78 in the block so as to protrude within the recess 80 defined between the reed channel 70 and the block 72. As shown in FIGS. 1 and 10, reed 65 is held in recess 80 by ball 75. Three such block positioned along the length of each channel 70 provides a relatively simple, yet accurate method of installing and removing a reed. The machine screw 73 is in essence a guide screw for preventing transverse movement of reed 65 while positioned in channel 70 by spring loaded block 72. The reed is slotted on the bottom (not shown) for placement over screw 73.

As seen in FIGS. 1 and 8, reed channel 70 is mounted by bolts 60 to flange 79. Blocks 81 are bolted to the flange. Each block has a horizontal bore 83. Guide rods 85 respectively pass through these bores. These guide rods are fastened to an elongated channel conduit 87, forming part of the machine frame 32, by a pair of apertured raised members 91 and 97. Thus transverse movement of the channel 70 by control rod 69 connected thereto by pin 61 is maintained in a horizontal plane by blocks sliding along guide rods 85.

Because of the ease of installing and removing reeds, a number of reeds have been developed, each reed having a different spacing and number of yarn guide ends associated therewith. In the preferred embodiment of the present invention, seven different reeds are associated with the beaming machine. These reeds are color-coded as illustrated in Chart 111 forming FIG. 12. Thus, the reed designated as red has a total of 80 guides or pigtails corresponding to the highest number of yarn ends for which that reed may be used. The number of pigtails for the other six types of reeds is similarly explained by FIG. 12.

As best seen in FIG. 12, the use of these reeds greatly facilitates the setup of the machine. Thus if 19 ends are to be wound on a particular beam, the chart would indicate that for this number of ends, the red reed should be used. Every fourth pigtail on the reed is used to obtain the desired number of ends; that is, one pigtail in, three pigtails out. Similarly, the same reed can be used for between 36 and 40 ends by using every other pigtail (that is, one pigtail in, one out) and can also be used for between 71 and 80 ends by using each pigtail, with the starting of the first yarn end on either the left or right-hand side of the machine eliminating those pigtails in excess of the number of ends desired. Thus, since the red reed contains 80 pigtails, if 72 ends were to be wound on the beam, the first eight on either the left-hand side or the right-hand side of the reed would be skipped with the remaining ones used.

Of course, other combinations of end counts can be obtained on the respective reeds by skipping more pigtails for that given reed. However, Chart 111 shown in FIG. 12 allows the operator to set up the machine for between 15 and 140 ends which is the range of ends normally used in Raschel-type knitting machines.

Thus, in setting up the machine, the operator selects the reed corresponding to the desired end count, snaps it into place within the reed channel, threads the ends through the beamer, and starts the machine. If the traverse movement of the control rod is more or less than required, it is adjusted (as described below) so that the right-hand termination of the first yarn end approaches the left-hand termination of the second yarn end, etc.

As seen in FIGS. 1 and 3, end flanges 84 are then moved by the operator to the left hand and right-hand termination of the first and last yarn ends so as to keep the wound yarn from slipping lengthwise on the beam.

The apparatus for achieving a desired traverse setting (i.e. a desired transverse motion of the control rods 69, 69'' and 69' for beams 22, 23 and 24, respectively) is best seen in FIGS. 1, 2, 4, 5, 6, and 7. FIG. 2, a rear perspective view of the multiple traverse assembly 53, shows that this assembly comprises three separately adjustable transverse movement mechanisms 86, 86' and 86'' to reciprocatively move control rods 69, 69'' and 69', respectively. This multiple transverse assembly further comprises a cam 88 incorporating a circumferential groove 89 in which cam follower 90 rides so as to impart transverse motion as shown by arrows 92 to mounting block 93.

The cam is supported within tank 105 which contains lubricating oil. The mounting block has a pair of holes 94 passing therethrough in which guide rods 95 and 96 pass so as to maintain the transverse motion of the mounting block within a desired path. The cam itself is turned by shaft 98 as shown by arrow 99 from the output of an infinitely variable speed transmission 133 (shown diagrammatically) which in turn is connected to the motor 21 (shown diagrammatically) that also drives each of the beams 22, 23 and 24. Thus, the transverse motion of the mounting block is directly proportional to the rotational velocity of the motor and thus to the rotational velocity of each of the beams.

Atop mounting block 93 is a pair of tabs 100 through which rod 101 passes. As best seen in FIGS. 2, 4, 5, 6, and 7, traverse movement assemblies 86, 86' and 86'' respectively include a transverse movement translation member 102, 103 and 104 pivotally mounted to the rod 101 and held in spaced relationship to the rod and to each other by means of nuts 106 and cylinder spacers 107, 108, 109 and 110. Each translation member respectively has an elongated slot 113, 113' and 113'' and a series of weight reducing holes 115.

Figure 4:
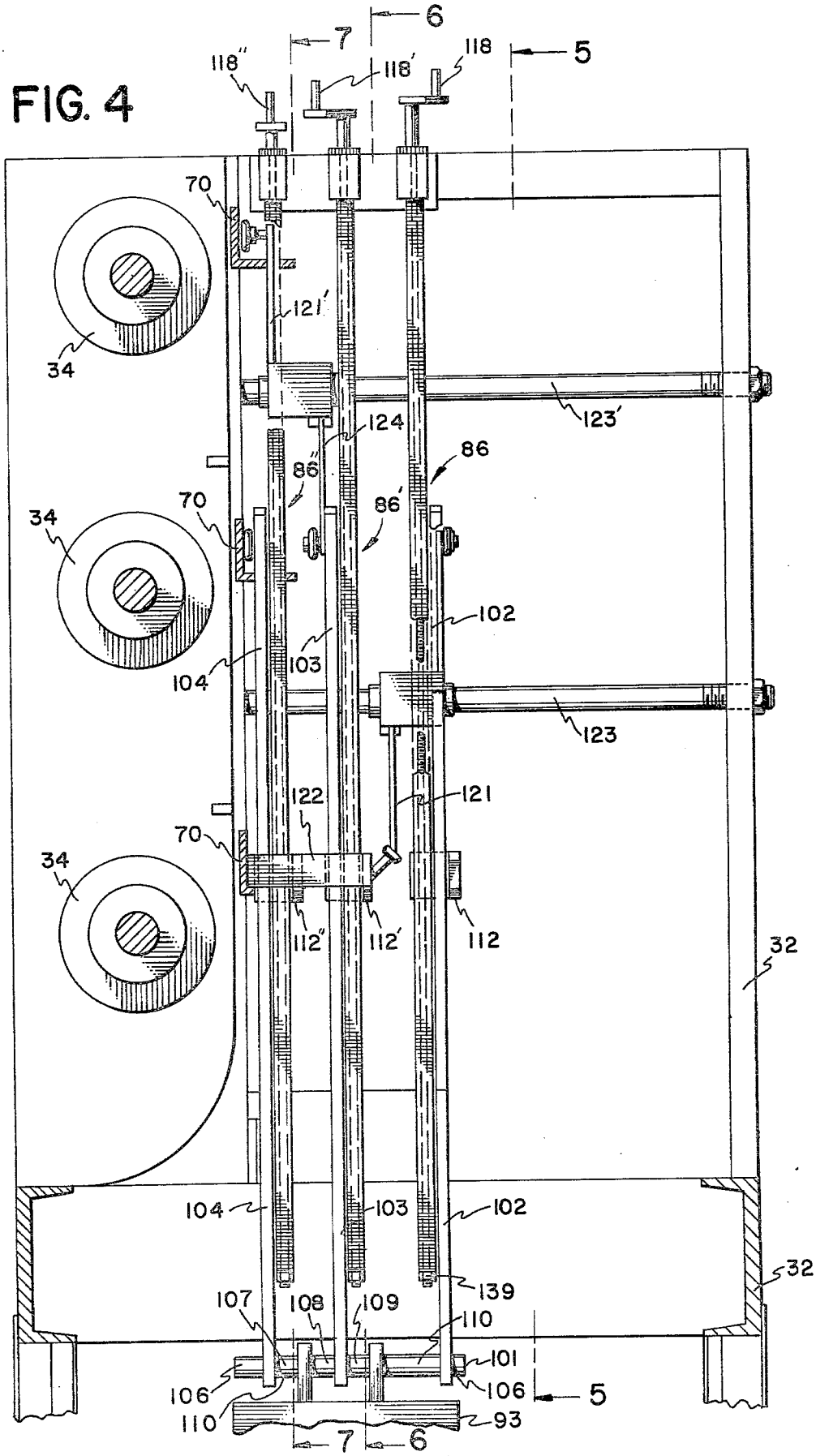
FIG. 4 is a cross-sectional view of the traverse assemblies for the three beams, taken along 4—4 of FIG. 3.
Figure 5:
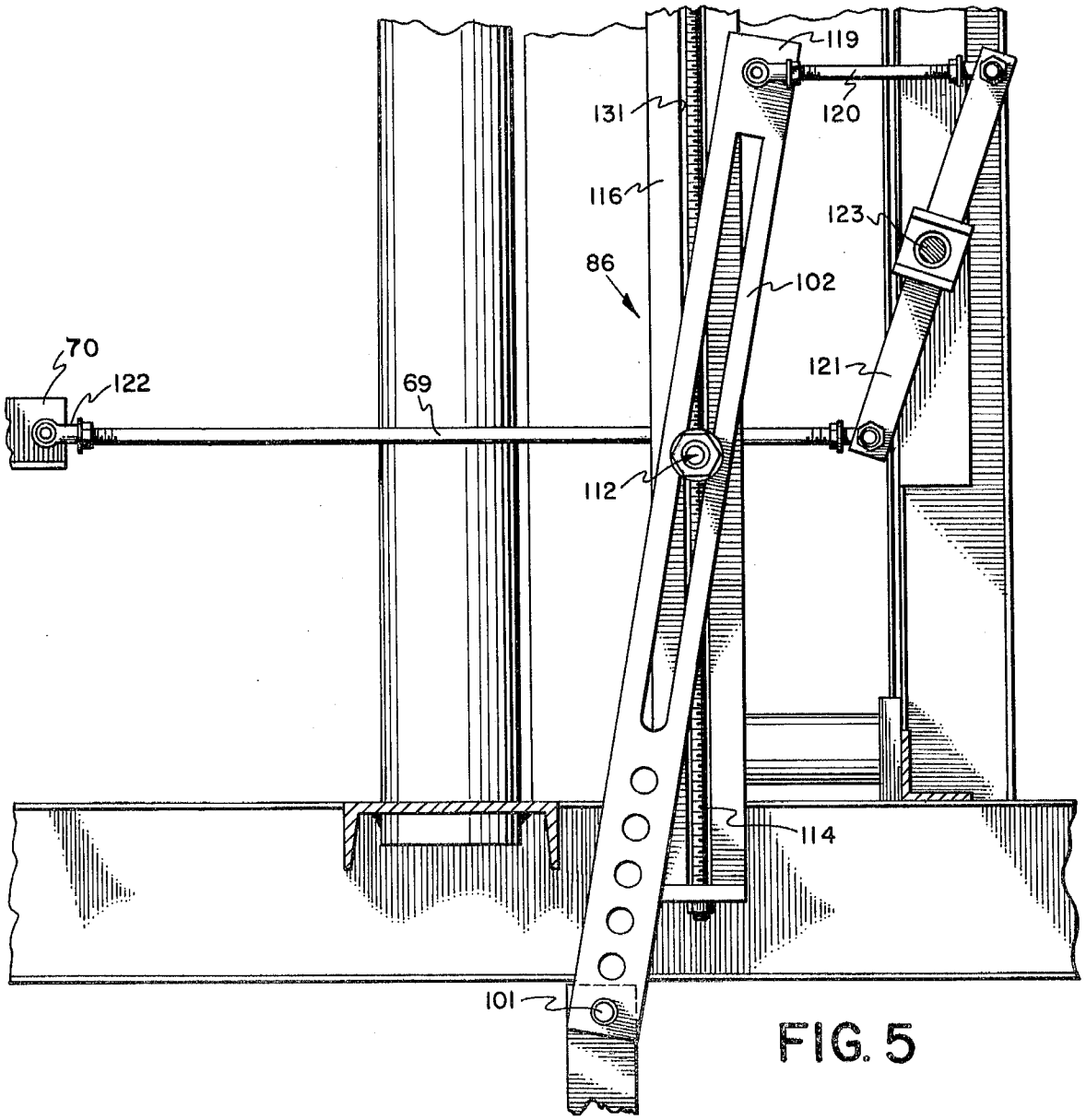
FIG. 5 is a rear elevational view of the rearwardmost traverse assembly taken along line 5—5 of FIG. 4 illustrating the traverse assembly controlling the lowermost beam of the beaming machine.

As best seen in FIGS. 2, 4 and 5, transverse movement of mounting block 93 causes corresponding transverse movement to control rod 69. The amount of transverse movement to control rod 69 is dependent upon the fulcrum at which pillow block 112 is placed within elongated slot 113. By principles of mechanics, it is readily apparent that the higher the placement of pillow block 112 with respect to slot 113, the less transverse movement imparted to control rod 69. Conversely, the lower pillow block 112 is placed with respect to slot 113, the greater the transvere movement of control rod 69. In the preferred embodiment of the present invention, the range of transverse movement obtained by each control rod is from 0.625 inches (1.5 cm) to 8 inches (20 cm). The adjustment of pillow block 112 is performed by threaded machine screw 114 which is journaled in support arm 116 at its upper end as shown in FIG. 1. The screw is positioned in elongated recess 131 of arm 116 and mounted through a hole in the lower portion of the arm by nut 139. A hand crank 118 provides for easy access by the operator in adjusting the pivot nut 112.

As shown in FIG. 4, similar threaded screws 114' and 114", support arms 116' and 116" with recesses 131' and 131", and handles 118' and 118" are used respectively to adjust corresponding pillow blocks 112' and 112" for translation members 103 and 104 respectively. These in turn move control rods 69' and 69" respectively. It should be noted that although pillow blocks 112, 112' and 112" are shown in the same relative position with respect to slots 113, 113' and 113", that this need not be the situation. Indeed, whenever different traverse settings for the beams are desired, the position of the corresponding pillow blocks in the slots will be different.

As best seen in FIGS. 2, 4, and 5, the mechanical interconnection from end 119 of translation member 102 to control rod 69 is made via connecting arms 120 and 121 and block 122. Connecting arm 121 is pivotally fixed to beamer frame 32 by means of axle 123. Block 122 is needed to connect rod 69 to reed channel 70 and thus connect around the barrier posed by frame column 35 (see FIG. 1).

Figure 6:
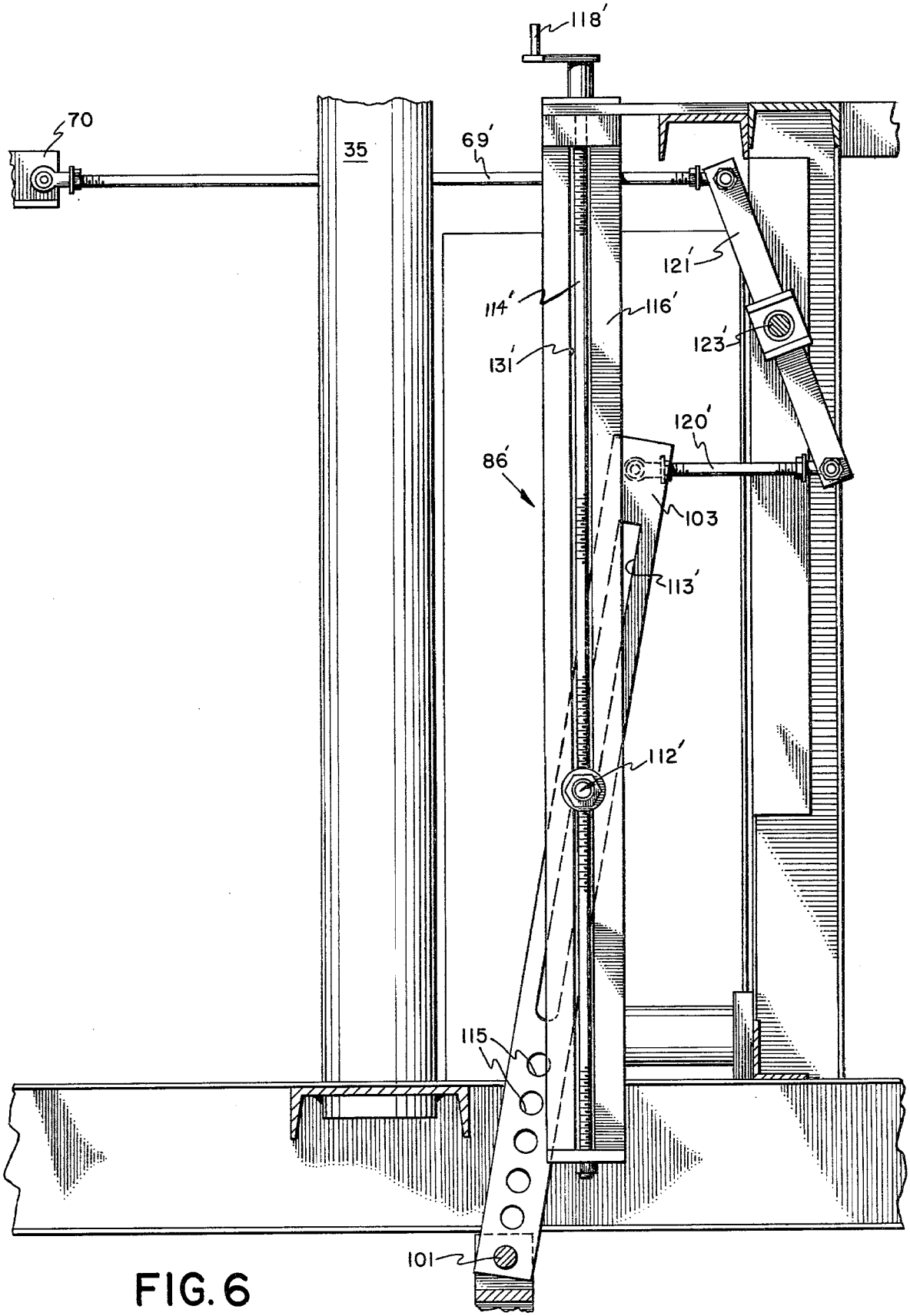
FIG. 6 is a rear elevational view of the middle traverse assembly taken along line 6—6 of FIG. 4 illustrating the traverse assembly controlling the uppermost beam of the beaming machine.
Figure 7:
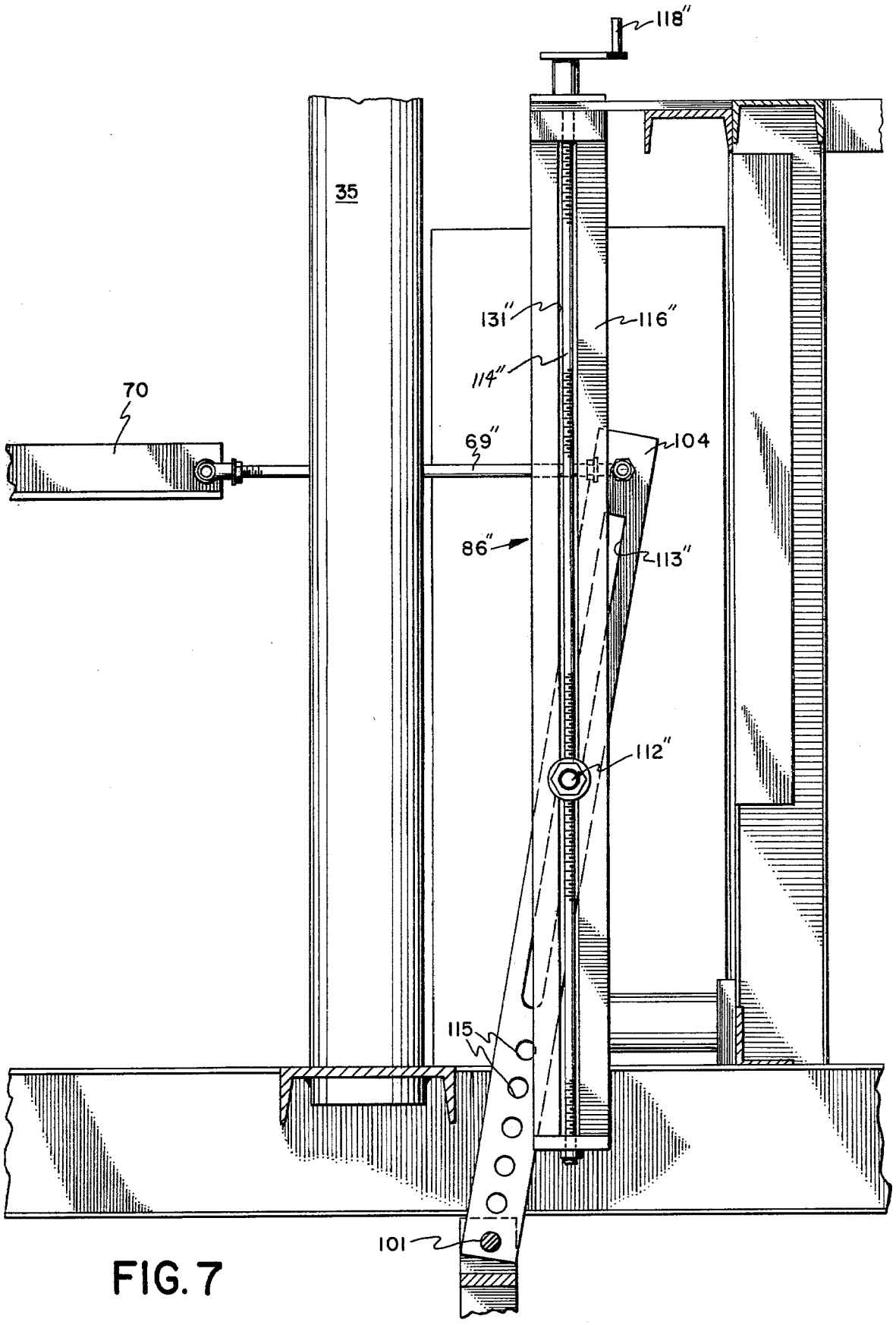
FIG. 7 is a rear elevational view of the forwardmost traverse assembly taken along line 7—7 of FIG. 4 illustrating the traverse assembly controlling the middle beam of the beaming machine.

As best seen in FIGS. 4, 6, and 7, translation members 103 and 104 are similarly used to drive corresponding control rods 69' and 69".

More specifically, and as shown in FIGS. 4 and 6, translation member 103 pivotally connects to connecting arm 120', which in turn connects to arm 121'. Arm 121' connects rod 69'. Axle 123' serves the same function as axle 123 with respect to connecting arm 124 for translation member 103.

As shown in FIGS. 1, 4 and 7, translation member 104 directly connects to control arm 69" since support arm 116" is forwardly spaced on frame 32 to be substantially aligned with reed channel 70". Since all the reed channels are in the same vertical plane, Z-shaped arms 121 and 124 are required on translation assemblies 86 and 86' to overcome the rearward placement of support arms 116 and 116', respectively. Thus, each reed channel associated with the corresponding rod is independently adjustable for any particular traverse setting desired. In this manner, the three beams shown in FIG. 3 can be individually set up for different yarn end counts.

As best seen in FIGS. 1 and 8 an air tube 125 having a longitudinal slit 126 generates an air sheet (as shown in phantom by 127) which is directed upward as shown by arrow 128 against the yarn ends 26. If any particular yarn end breaks, it is thrown upwardly as shown by yarn end 26*.

As shown in FIG. 1, this upward movement of the broken yarn end is detected by light beam 130 which is projected by light source 141 (shown diagrammatically in FIG. 3 in phantom) from the right-handmost side of the beamer as viewed in FIG. 3 towards a mirror 132 mounted on the left-hand side of the beaming machine. The light source is a collimated beam well-known in the photoelectric detection art and the reflected beam is detected by a photodetector 142 (shown diagrammatically in phantom), also well known in the photoelectric detection art. The light source and photodetector comprise an electric eye stop-motion apparatus. In the preferred embodiment of the present invention, this apparatus is one manufactured by Appalachian Electronic Instruments, 810 West Monroe Ave., Ronceverte, W. Va. 24970.

When a broken end such as end 26* breaks this beam, it is detected by the photodetector which in turn energizes a solenoid 134 as shown in FIG. 11. The energizing of this solenoid causes its associated rod 136 to move downwardly as shown by arrow 137 which causes strap 138 mounted at one end to rod 54 to tighten about roller 47. This thereby brakes the roller 47 which in turn brakes the upper roller 46 via gears 57 and 56. This braking prevents the rotating inertia of the rollers from pulling the yarns from the creels as the beams 24 are stopped as the driving motor 21 (see FIG. 2) is brought to a stop by stopping means 27 activated by photodetector 142 when the yarn end break is detected. It is found that this method of detecting a broken yarn ends in yarn sheet 140 is preferable to other techniques used on prior art beaming machines. Typically, these prior art devices had a mechanical sensor arm through which each yarn end individually passed. This arm would drop and cause closure of a switch if a particular yarn end broke. The problem with such devices is that when used in conjunction with yarn ends made from synthetic material, the accumulated oil on the mechanical yarn detecting arm could coat the arm and thereby prevent the electrical contact when it swung downward so as to mate with the remaining portions of the switch.

The present invention completely eliminates such mechanical devices and also eliminates the time consuming setup associated with such mechanical devices.

As best seen in FIGS. 1, 3 and 8, pressurized air is generated by two blowers 144. This pressurized air is brought to each air tube 125 by hollow vertical and horizontal conduit frame members 35 and 87 respectively. This method of air delivery eliminates the need for air hoses from the blowers. By so doing, the beaming machine is less cluttered and therefore easier to set up. Two blowers are used to maintain adequate air flow for the three air tubes.

Thus, what has been described is an improved beaming machine which is able to simultaneously wind three beams, each having any particular end count and traverse setting desired. In addition, the present invention has a new tension equalizing device so that all of the yarn ends have approximately the same tension when wound about the beam regardless of their tensions as they leave their creels. A new type of yarn end guide is also disclosed which is in the shape of a pigtail. These pigtails are furthermore mounted in individual reeds which may be color-coded so as to enable the operator to choose the particular reed needed for obtaining a desired end count. The present invention also discloses the generation of an air sheet so as to detect broken yarn ends whereby the machine can be brought to a safe stop.

The end product from this machine is thus three individual beams having uniform yarn tension and any desired end counts for each beam. Since one person can operate the machine, and since the doffing time is kept to a minimum, the productivity of this beaming machine is much greater than that of prior art machines.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing(s) shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention, what I claim is:

1. An improved beaming machine of the type having at least one beam upon which yarn ends are wound from at least one storage creel, a motor for rotationally driving the beam, a reed, and a frame for housing the motor, beam, and reed, in which the improvement is characterized by:

(A) a plurality of beams and reeds (65);

(B) a multiple traverse assembly (53) having, (1) means for mechanically moving in a reciprocating motion;

(2) a transverse movement translation member (102, 103 or 104) for each beam connected at one end to the reciprocating motion means and having a manually adjustable fulcrum;

(3) means for manually adjusting the fulcrum of each translation member;

(4) means, connected to each translation member and to each reed, for mechanically connecting the translation member to the reed;

whereby each reed associated with each beam is manually adjustable for any traverse movement desired.

2. An improved beaming machine as defined in claim 1, wherein the reciprocating motion means is a cam (88) and cam follower (90).

3. An improved beaming machine as defined in claim 2, wherein each translation member has an elongated slot and wherein the means for manually adjusting the translation member fulcrum comprises a support arm (116) connected to the frame, an elongated threaded screw (114) rotatably mounted to the support arm, a handle (118) connected at one end to the threaded screw for turning the screw, and a pillow block (112) threadedly connected to the screw and slidably positionable in the translation member slot; whereby turning of the handle moves the pillow block along the translation member slot, thereby adjusting the fulcrum of the translation member and thus the amount of reciprocating motion of the connected reed.

4. An improved beaming meahine as defined in claim 1 or 3 wherein the improvement further comprises a yarn tension equalizing mechanism (44) comprising for each beam:

(1) a first roller (46) pivotally connected to the frame over which each yarn end passes, (2) a second roller (47) pivotally connected to the frame over which each yarn end passes after leaving the first roller, and (3) means for retarding the rotation of the first and second rollers so that there is slippage between the yarn ends and the rollers as the yarn ends are wound on the beam, whereby the yarn end tension variations are equalized, resulting in a uniformly wound beam.

5. A beaming machine as defined in claim 4, wherein the improvement further comprises an improved reed system comprising:

(A) said plurality of reeds (65) being removably mountable to the beaming machine, and (B) yarn end guides (62) on said reeds in the shape of pigtails for facilitating passage of yarn ends therethrough.

6. A beaming machine as defined in claim 5, further comprising an improved reed system comprising reed channels (70) mounted to the beaming frame, and blocks (72) mounted to the reed channels (70), the blocks having spring loaded balls (75) each protruding toward a corresponding channel (70), so that a reed is mounted on a channel (70) and held in place by the balls of the blocks (72).

7. An improved beaming machine as defined in claim 5, further comprising for each beam, means for generating an air sheet directed toward the yarn ends, a source of collimated light projecting across the yarn ends so as to be broken when a yarn end breaks and is blown into the path of the light by the means for generating the air sheet; means for detecting breakage of the light beam, and means activated by the light detecting means for braking rollers of the yarn tension equalizing mechanism and for stopping the beaming machine when a breakage of the light beam occurs.

8. An improved beaming machine as defined in claim 7, wherein the means for generating an air sheet comprises at least one blower mounted to the frame for generating pressurized air, an air tube with a slit for generating an air sheet when supplied with pressurized air, and a hollow conduit frame member to pass pressurized air from the blower to the air tube.

9. An improved beaming machine as defined in claim 1, further comprising a yarn tension equalizing mechanism comprising:

(A) an upper roller (46) pivotally mounted to the frame, over which each yarn end passes as it enters the beaming machine;

(B) a lower roller (47), pivotally mounted to the frame and positioned rearwardly with respect to the upper roller and beam, over which each end further passes as it leaves the upper roller; and (C) means for imparting friction to the rotation of each roller.

10. An improved beaming machine as defined in claim 9, wherein the means for imparting friction to the rollers comprises a first gear (56) mounted to the upper roller, a second gear (57) mounted to the lower roller, the second gear having more gear teeth than the first gear, and intermeshing with the first gear so that the rotational velocity of the upper roller is slightly greater than the rotational velocity of the lower roller, said means for imparting friction to the rotation of each roller comprising a pulley (45) mounted to one of the rollers, a strap (49) placed within a portion of the pulley, the strap having one end fixed to the beaming frame, and a weight (50) mounted to the other end of the strap so as to impart friction from the strap to the pulley; whereby the upper roller's rotational velocity is slightly greater than the lower roller's rotational velocity and thereby tends to pull all of the yarn ends including those which have a higher tension than the remaining yarn ends to the beaming machine, and thereby equalizes the tension of the yarn ends as they are wound about the beam.

11. An improved beaming machine as defined in claim 10, wherein the rollers further comprise a rubberized coating on their periphery so as to increase the friction between the rollers and each of the yarn ends that pass across them.

12. An improved beaming machine as defined in claim 9, wherein the rollers further comprise a rubberized coating on their periphery so as to increase the friction between the rollers and each of the yarn ends that pass across them.

* * * * *